US010153106B1

(12) United States Patent
Tsai

(10) Patent No.: US 10,153,106 B1
(45) Date of Patent: Dec. 11, 2018

(54) KEYBOARD STRUCTURE

(71) Applicant: Primax Electronics Ltd., Taipei (TW)

(72) Inventor: Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/830,766

(22) Filed: Dec. 4, 2017

(30) Foreign Application Priority Data

Sep. 28, 2017 (TW) ..... 106133428 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/84*** | (2006.01) |
| ***H01H 13/83*** | (2006.01) |

(52) U.S. Cl.
CPC ..... *H01H 13/84* (2013.01); *H01H 13/83* (2013.01); *H01H 2221/07* (2013.01)

(58) Field of Classification Search
CPC ..... H01H 13/85; H01H 2209/01; H01H 2215/00; H01H 2215/004; H01H 2215/024; H01H 2215/008; H01H 2215/012; H01H 2215/018; H01H 2215/038; H01H 2219/036; H01H 2219/052; H01H 2219/06; H01H 2219/062; H01H 2221/076; H01H 2227/026; H01H 2229/046; H01H 2239/004; H01H 3/125; H01H 13/06; H01H 13/023; H01H 13/04; H01H 13/70; H01H 13/7006; H01H 13/79; H01H 13/80; H01H 13/803; H01H 13/83; H01H 13/86; H01H 2203/004; H01H 2203/038; H01H 2203/056; H01H 2205/016; H01H 2205/024; H01H 2207/04; H01H 2211/028; H01H 2213/01; H01H 2213/016
USPC ..... 200/402, 405, 406, 408, 412, 440, 468
See application file for complete search history.

(56) References Cited

U.S. PATENT DOCUMENTS 5,149,923 A * 9/1992 Demeo ..... H01H 13/702 200/314
2008/0251370 A1* 10/2008 Aoki ..... H01H 13/79 200/534

* cited by examiner

*Primary Examiner* — Anthony R. Jimenez
(74) *Attorney, Agent, or Firm* — Kirton McConkie; Evan R. Witt

(57) ABSTRACT

A keyboard structure, including: a keycap; a transparent membrane layer; and an elastic element, disposed between the keycap and the transparent membrane layer and having a press portion, where the transparent membrane layer includes: a first opening corresponding to the keycap; a hard membrane layer, having an extension portion that is formed at an inner edge of the first opening inner edge; and a spacer layer, disposed under the hard membrane layer and used for forming a gap. When the keycap is pressed with an external force, the elastic element is deformed to enable the press portion to move downward and abut against the extension portion, so that the extension portion generates a bending deformation in the gap; and when the external force is released, the elastic element and the extension portion are elastically recovered and the extension portion generates a sound.

9 Claims, 5 Drawing Sheets

KEYBOARD STRUCTURE

FIELD OF THE INVENTION

The present invention relates to a structure of an input device, and in particular, to a backlight structure of a keyboard.

BACKGROUND OF THE INVENTION

Nowadays, use of electronic products has become an indispensable part of life. Every aspect of life, including eating, clothing, housing, transportation, education, entertainment and so on, is related to electronic devices. To make it easier to carry or use the electronic products, the electronic products are designed to be lighter and thinner. Generally, an electronic product is provided with a keyboard. For example, when the keyboard is of a mechanical structure, a keyboard bearing is usually provided. Types of keyboard bearings are generally distinguished by using colors such as indigo, red, black, tan, and green. When being pressed, keyboard bearings of different colors produce different hit sounds and press strengths, thus forming different hit feelings. A proper hit sound and press strength can also help a user keep a good typing tempo.

To make an electronic product lighter and thinner, generally, an attempt is made to simplify the configuration of a support structure or an elastic structure in the keyboard structure or reduce the height of the support structure, so as to achieve the effect of reducing the overall keyboard size. Therefore, the keyboard structure in a thin and light keyboard generally is not designed with a keyboard bearing. As a result, the keyboard cannot produce a proper hit sound. Consequently, a user cannot timely determine whether a press on the keyboard is finished, or even an uncomfortable press feeling may be generated, making it impossible for the user to keep the original good typing tempo.

Therefore, how to enable a keyboard to produce a proper hit sound while the structure of the keyboard is simplified in design is a technical problem to be solved in the present invention.

SUMMARY OF THE INVENTION

A main objective of the present invention is to provide a keyboard structure that can generate a proper hit sound.

In order to achieve the foregoing objective, the present invention provides a keyboard structure, including:

a keycap;

a transparent membrane layer, disposed under the keycap and including:

a first opening, corresponding to the keycap;

a hard membrane layer, having at least one extension portion that is formed at an inner edge of the first opening; and a spacer layer, disposed under the hard membrane layer and used for forming a gap; and an elastic element, disposed between the keycap and the transparent membrane layer and having a press portion;

where when the keycap is pressed with an external force, the elastic element is deformed to enable the press portion to move downward and abut against the extension portion, so that the extension portion generates a bending deformation in the gap; and when the external force is released, the elastic element is elastically recovered so that the press portion moves away from the extension portion, and the extension portion is elastically recovered and generates a sound.

In the foregoing preferred implementation, the elastic element includes an elastic support portion and an abutment portion disposed opposite to the press portion, the abutment portion is used for abutting against the keycap, the elastic support portion is fixed on the hard membrane layer and is used for providing an elastic resilience to the keycap.

In the foregoing preferred implementation, the keyboard structure includes a membrane switch layer disposed under the transparent membrane layer, the membrane switch layer has at least one switch corresponding to the first opening, and the switch has a light through hole.

In the foregoing preferred implementation, when the keycap is pressed with the external force, the press portion enters into the first opening and touches the switch, so as to generate a keyboard signal In the foregoing preferred implementation, the keyboard structure includes a flexible circuit board disposed under the membrane switch layer, the flexible circuit board includes a light emitting element and a second opening corresponding to the switch, the light emitting element is disposed on a lower surface of the flexible circuit board and corresponds to the second opening.

In the foregoing preferred implementation, the light emitting element is used for generating a light beam which passes through the second opening, the light through hole and the first opening in sequence, and is diffused to the keycap through the transparent membrane layer.

In the foregoing preferred implementation, the keyboard structure includes a support board disposed under the flexible circuit board, the support board has a third opening, and the third opening is used for accommodating the light emitting element.

In the foregoing preferred implementation, the light emitting element is a light emitting diode (LED) module or an electro luminescence (EL) module.

In the foregoing preferred implementation, a material of the transparent membrane layer is: Polyethylene terephthalate (PET) or Polycarbonate (PC).

DETAILED DESCRIPTION OF THE PREFERRED EMBODIMENT

Advantages of the present invention and methods for achieving the advantages will be described in further detail with reference to the exemplary embodiments and accompanying drawings, to facilitate comprehension. However, the present invention may be implemented in different forms, but should not be construed as being limited to the embodiments described herein. On the contrary, for a person of ordinary skill in the part, the provided embodiments make this disclosure more thorough and comprehensive, and convey the scope of the present invention more completely.

Figure 1A:
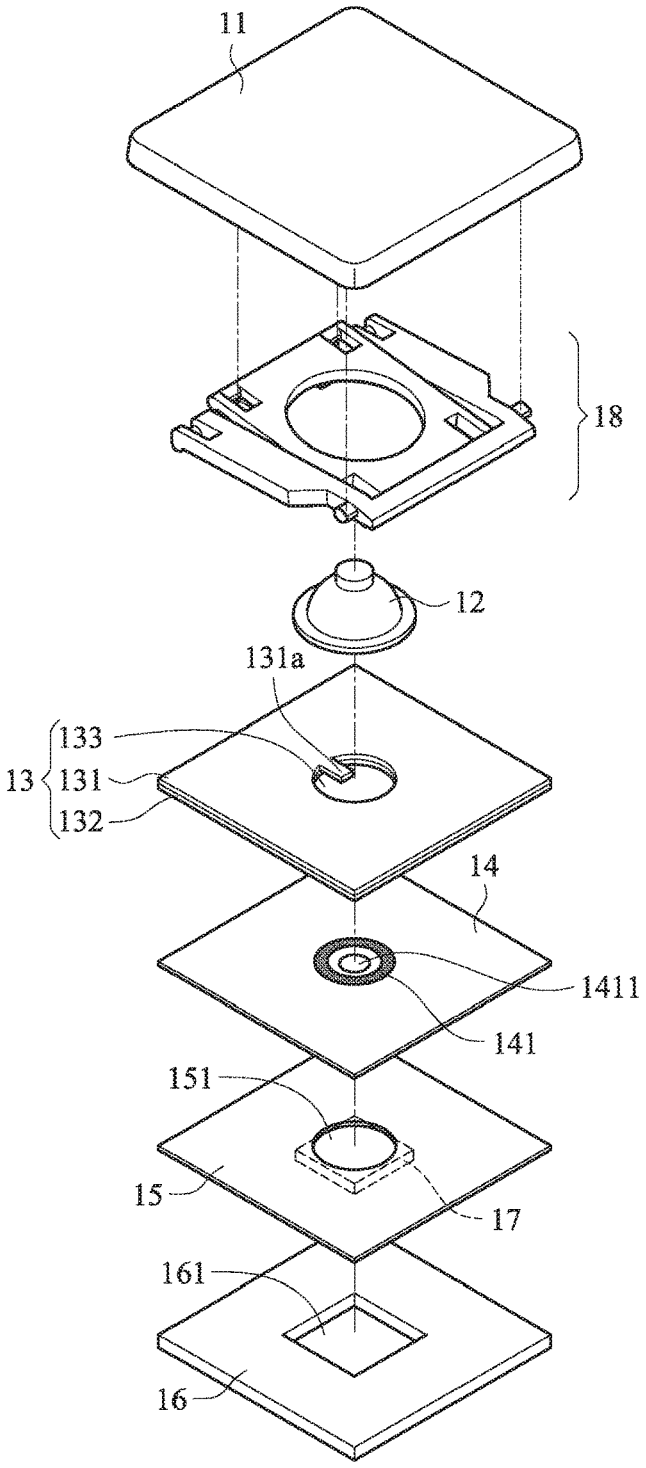
FIG. 1A is a three-dimensional schematic diagram of a keyboard structure according to the present invention.

First, referring to FIG. 1A, FIG. 1A is a three-dimensional schematic diagram of a keyboard structure according to the present invention. In FIG. 1A, a keyboard structure 10 of the present invention includes: a keycap 11, an elastic element 12, a transparent membrane layer 13, a membrane switch layer 14, a flexible circuit board 15, a support board 16, a light emitting element 17 and a support element 18. The transparent membrane layer 13, the membrane switch layer 14 and the flexible circuit board 15 are sequentially disposed above the support board 16 from top to bottom. The support board 16 is used for supporting the whole keyboard structure 10.

Figure 1B:
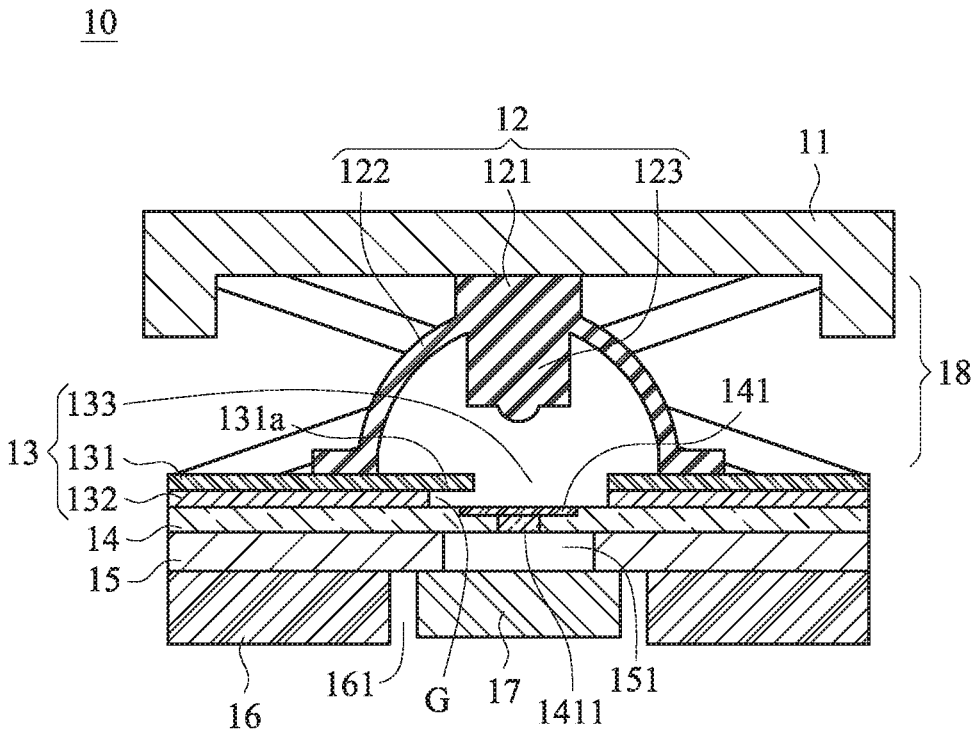
FIG. 1B is a cross-section view of a keyboard structure according to the present invention.

Next, referring to FIG. 1B, FIG. 1B is a cross-section view of a keyboard structure according to the present invention. In FIG. 1B, the membrane switch layer 14 has at least one switch 141 disposed corresponding to the keycap 11, and the center of the switch 141 is provided with a light through hole 1411 that allows a light beam to pass through. In this embodiment, the light through hole 1411 is circular, but in actual application, the light through hole 1411 may be cross-shaped or in other geographical shapes.

The transparent membrane layer 13 is disposed above the membrane switch layer 14 and can be used as a conducting medium of backlight of the keyboard, so that a light beam can be diffused to the surface of the keycap 11 through the transparent membrane layer 13. The transparent membrane layer 13 has a hard membrane layer 131, a spacer layer 132, and a first opening 133 provided corresponding to the switch 141. In this embodiment, the hard membrane layer 131 may extend at an inner edge of the first opening 133 to form an extension portion 131*a*. The thickness of the extension portion 131*a* is the same as the thickness of the hard membrane layer 131. The spacer layer 132 is disposed under the hard membrane layer 131 and is used for separating the hard membrane layer 131 from the membrane switch layer 14, so as to provide a gap G between the hard membrane layer 131 and the membrane switch layer 14. In addition, the material of the transparent membrane layer 13 may be Polyethylene terephthalate (PET) or Polycarbonate (PC).

Referring to FIG. 1B continuously, the elastic element 12 is disposed under the keycap 11, that is, at a position between the keycap 11 and the transparent membrane layer 13 and corresponding to the first opening 133. The elastic element 12 includes: an abutment portion 121, an elastic support portion 122 and a press portion 123. The press portion 123 is disposed at a position, which corresponds to the switch 141, at the top of an internal space of the dome-shaped elastic support portion 122. The abutment portion 121 is disposed at the other end opposite to the press portion 123 and is used for abutting against the keycap 11. The elastic support portion 122 may fix the elastic element 12 on the hard membrane layer 133 of the transparent membrane layer 13 by means of adhesion, and is used for providing an elastic resilience to the keycap 11. In an embodiment of the present invention, the elastic element 12 may be made of a rubber material or silicon material pervious to light.

The flexible circuit board 15 is disposed under the membrane switch layer 14, that is, between the membrane switch layer 14 and the support board 16. The flexible circuit board 15 has a light emitting element 17 and a second opening 151 provided corresponding to the switch 141. The light emitting element 17 is disposed at a position, which corresponds to the second opening 151, on the lower surface of the flexible circuit board 15, so that a light beam generated by the light emitting element 17 can pass through the second opening 151, the light through hole 1411 of the switch 141 and the first opening 133 in sequence. Then, the light beam can be diffused to the keycap 11 through the transparent membrane layer 13 or the elastic element 12 that is pervious to light, so that the surface or a character symbol area (not shown in the figure) of the keycap 11 produces a light-emitting visual effect. The support board 16 disposed under the flexible circuit board 15 has a third opening 161 for accommodating the light emitting element 17. On the other hand, the flexible circuit board 15 may also be used for providing power to the membrane switch layer 14 and the light emitting element 17. The light emitting element 17 may be a light emitting diode (LED) module or an electro luminescence (EL) module.

The support element 18 is disposed between the keycap 11 and the support board 16, and may be pivotally connected (not shown in the figure) to the keycap 11 and the support board 16 respectively, so as to guide the keycap 10 to move up and down with respect to the support board 16. In this embodiment, the support element 18 may be a scissors structure. However, in actual application, the support element 18 may also be a V-type connecting rod structure, A-type connecting rod structure, or a structure of two parallel connecting rods.

Figure 2A:
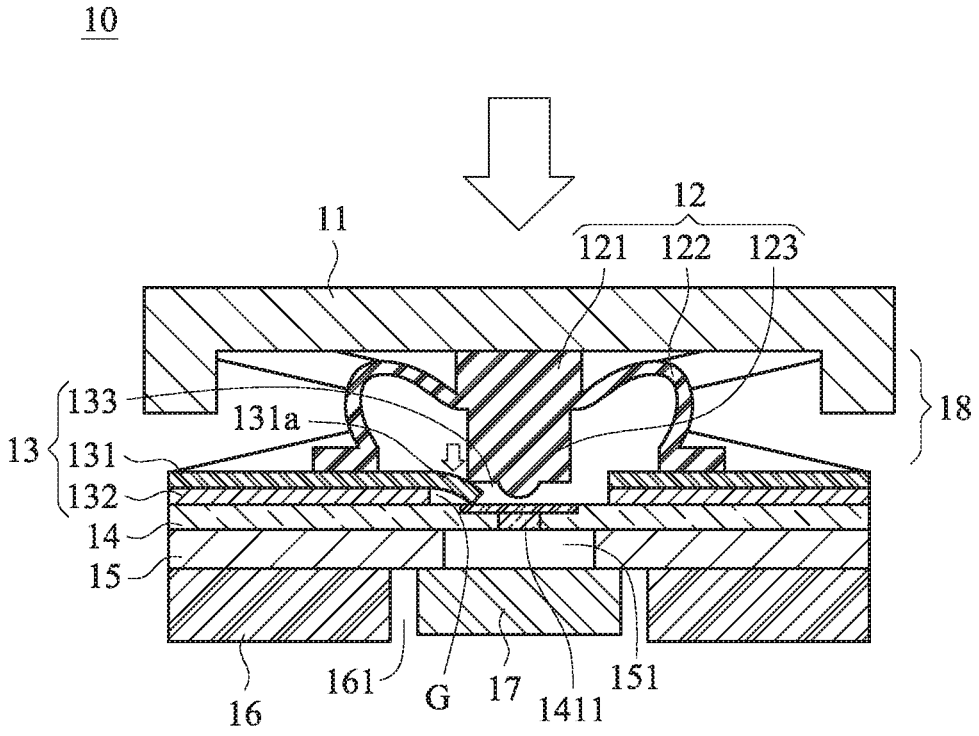
FIG. 2A to FIG. 2B are schematic diagrams of actuation of a keyboard according to the present invention.
Figure 2B:
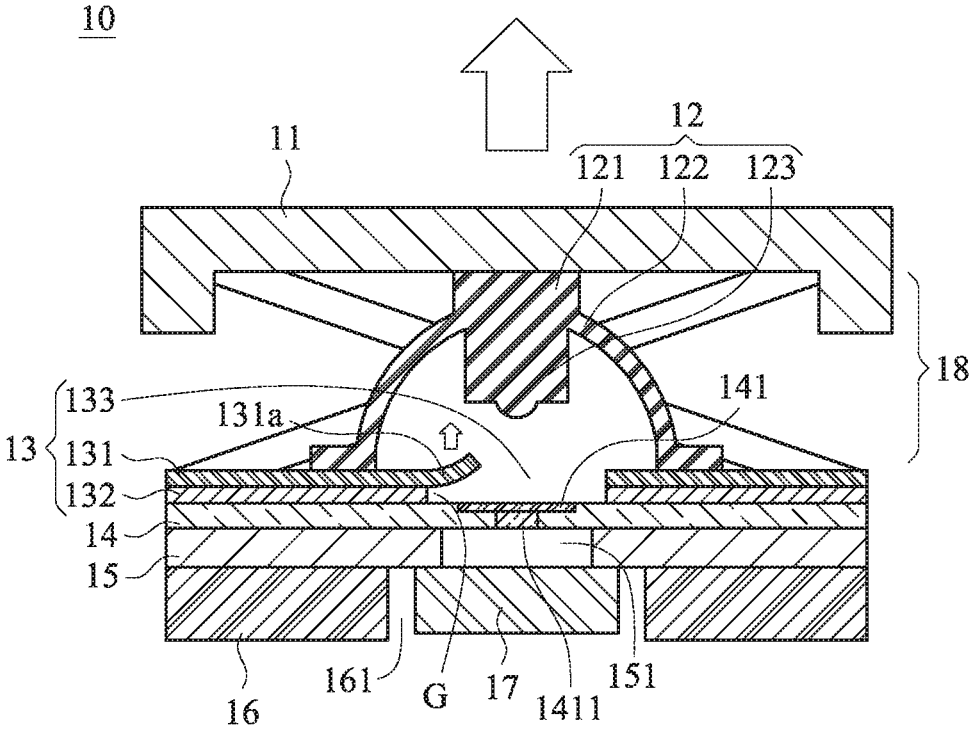

Referring to FIG. 2A to 2B, FIG. 2A to 2B are schematic diagrams of actuation of a keyboard according to the present invention. In FIG. 2A, when the keycap 11 is pressed with an external force, the lower surface of the keycap 11 abuts against the abutment portion 121 of the elastic element 12 and enables the elastic support portion 122 of the elastic element 12 to be deformed. In this case, the press portion 123 moves downward and presses the extension portion 131*a*, so that the extension portion 131*a* produces a bending deformation in the gap G formed by the spacer layer 132. The press portion 123 continues to enter into the first opening 133 and touches the switch 141, so that the switch 141 is triggered and generates a corresponding keyboard signal.

Next, referring to FIG. 2B, when the external force is released, the elastic element 12 provides an upward elastic resilience to the keycap 11, thereby pushing the keycap 11 to rise and be restored. In this case, the press portion 123 of the elastic element 12 also moves upward, and moves away from the extension portion 131*a*. When the extension portion 131*a* is no longer pressed by the press portion 123, the extension portion 131*a* is elastically recovered and produces a sound at the same time. In this way, with the sound generated during elastic recovery of the extension portion 131*a*, a hit sound of the keyboard is clearer and louder, so that a user can still keep a good typing tempo when using a thin keyboard.

Figure 3A:
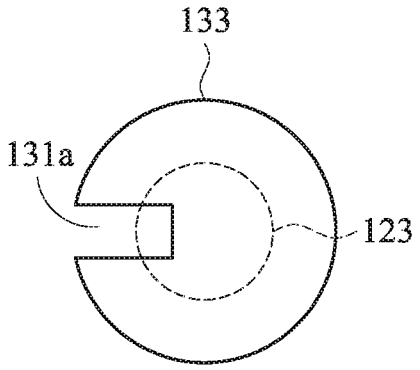
FIG. 3A is a schematic top view of a first embodiment of an extension portion of a hard membrane layer.
Figure 3B:
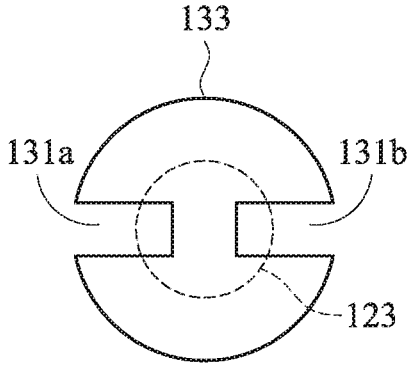
FIG. 3B is a schematic top view of a second embodiment of an extension portion of a hard membrane layer.

Referring to FIG. 3A and FIG. 3B, FIG. 3A is a schematic top view of a first embodiment of an extension portion of a hard membrane layer; and FIG. 3B is a schematic top view of a second embodiment of an extension portion of a hard membrane layer. In FIG. 3A, the extension portion 131*a* extended from the hard membrane layer 131 (as shown in FIG. 1) is formed at the inner edge of the first opening 133, and an extension end thereof is located on a movement path of the press portion 123. In the present invention, the tone of the sound generated during elastic recovery of the extension portion 131*a* may be adjusted by adjusting the thickness or length thereof. When the extension portion 131*a* becomes thinner or shorter, the tone of the sound generated during elastic recovery becomes higher; when the extension portion 131*a* becomes thicker or longer, the tone of the sound generated during elastic recovery becomes lower.

In FIG. 3B, the hard membrane layer 131 may also extend on another side opposite to the extension portion 131*a*, to form another extension portion 131*b*. In this way, the volume of the keyboard hit sound may be increased by using the sound generated during elastic recovery of the two extension portions 131*a* and 131*b*. Although the present invention provides the implementations of forming an extension portion at the inner edge of the first opening 133 and forming two extension portions on two opposite sides, during actual application, multiple extension portions may be formed on any position at the inner edge of the first opening 133 as required. The implementations provided in the present invention do not constitute any limitation.

Compared with the conventional technology, in the keyboard structure provided in the present invention, the keyboard can produce a proper hit sound by means of a sound generated during elastic recovery of the extension portion, so that the keyboard hit sound is clearer and louder. Therefore, a user can still maintain a good typing tempo when using a thin keyboard. On the other hand, the disposition manner of accommodating the light emitting element of the flexible circuit board in the opening formed in the support board can also effectively reduce the overall stacking thickness of the keyboard structure. Therefore, the present invention is a creation of great industrial value.

Various modifications may be made to the present invention by a person skilled in the art without departing from the protection scope of the appended claims.

What is claimed is:

1. A keyboard structure, comprising:

a keycap;

a transparent membrane layer disposed under the keycap, comprising:

a first opening corresponding to the keycap;

a hard membrane layer, having at least one extension portion that is formed at an inner edge of the first opening; and a spacer layer, disposed under the hard membrane layer and used for forming a gap; and an elastic element, disposed between the keycap and the transparent membrane layer, and having a press portion;

wherein when the keycap is pressed with an external force, the elastic element is deformed to enable the press portion to move downward and abut against the at least one extension portion, so that the at least one extension portion generates a bending deformation in the gap; and when the external force is released, the elastic element is elastically recovered so that the press portion moves away from the at least one extension portion, and the at least one extension portion is elastically recovered and generates a sound.

2. The keyboard structure according to claim 1, wherein the elastic element comprises an elastic support portion and an abutment portion disposed opposite to the press portion, the abutment portion is used for abutting against the keycap, the elastic support portion is fixed on the hard membrane layer and is used for providing an elastic resilience to the keycap.

3. The keyboard structure according to claim 1, wherein a material of the transparent membrane layer is: Polyethylene terephthalate (PET) or Polycarbonate (PC).

4. The keyboard structure according to claim 1, comprising a membrane switch layer disposed under the transparent membrane layer, the membrane switch layer has at least one switch corresponding to the first opening, and the at least one switch has a light through hole.

5. The keyboard structure according to claim 4, wherein when the keycap is pressed with the external force, the press portion enters into the first opening and touches the at least one switch, so as to generate a keyboard signal.

6. The keyboard structure according to claim 4, comprising a flexible circuit board disposed under the membrane switch layer, the flexible circuit board comprises a light emitting element and a second opening corresponding to the at least one switch, the light emitting element is disposed on a lower surface of the flexible circuit board and corresponds to the second opening.

7. The keyboard structure according to claim 6, wherein the light emitting element is used for generating a light beam which passes through the second opening, the light through hole and the first opening in sequence, and is diffused to the keycap through the transparent membrane layer.

8. The keyboard structure according to claim 6, comprising a support board disposed under the flexible circuit board, the support board has a third opening, and the third opening is used for accommodating the light emitting element.

9. The keyboard structure according to claim 6, wherein the light emitting element is a light emitting diode (LED) module or an electro luminescence (EL) module.

* * * * *